United States Patent [19]

Brown et al.

[11] Patent Number: 4,478,017

[45] Date of Patent: Oct. 23, 1984

[54] FLOORING PROTECTION SYSTEM

[76] Inventors: William R. Brown, 2521 E. 35th, Spokane, Wash. 99203; Baxter Brown, Box 1313, Coeur d'Alene, Id. 83814

[21] Appl. No.: 479,721

[22] Filed: Mar. 28, 1983

[51] Int. Cl.[3] ..... E06B 7/14

[52] U.S. Cl. ..... 52/209; 52/287; 52/302; 52/273; 16/7

[58] Field of Search ..... 52/273, 302, 303, 60, 52/209, 287, 288, 169.5; 16/4, 7, 8

[56] References Cited

U.S. PATENT DOCUMENTS

| | | | |
|---|---|---|---|
| 383,849 | 6/1888 | Barrow | 16/4 |
| 852,450 | 5/1907 | Plym | 52/209 |
| 1,268,032 | 5/1918 | McGowan | 52/209 |
| 1,776,818 | 9/1930 | Reuter | 52/209 |
| 2,703,002 | 3/1955 | Suskind | 52/302 |
| 3,719,010 | 3/1973 | Hickman | 52/60 |

FOREIGN PATENT DOCUMENTS

| | | | |
|---|---|---|---|
| 6600700 | 7/1967 | Netherlands | 52/209 |

*Primary Examiner*—John E. Murtagh
*Attorney, Agent, or Firm*—Wells, St. John & Roberts

[57] ABSTRACT

Disclosed is a flooring protection system for use around windows, doors or other opening in a wall. The flooring protection system includes a barrier piece which is securely attached to the floor to retain liquid leakage within a confined area. A cover piece is adapted to interengage with the barrier piece and to provide a means for supporting and securing a floor covering thereon. The flooring protection system has a configuration which hides mounting fasteners from view and provides a threshold which protects the edges of floor covering materials.

11 Claims, 5 Drawing Figures

FLOORING PROTECTION SYSTEM

TECHNICAL FIELD

The technical field of this invention is systems for protecting floors and flooring from damage by water or other liquids.

BACKGROUND OF THE INVENTION

Heavy rains accompanied by high winds are a common problem in many parts of the country. The wind-driven rain blows in and around window and door frames, especially in cases such as sliding glass doors and windows having metal frames. This is particularly a problem when the frames are not adequately sealed with the adjacent structure. Once the water is inside it usually soaks into carpeting which is secured to the floor in most installations. Because the carpet is securely attached to the floor it is very difficult to dry. The carpet is more easily dried if removed from the floor but this is a costly and time consuming procedure. The water also causes the underlying floor to become wet and can lead to destruction of the floor and the supporting floor joist or other floor structure.

The current invention seeks to solve the above problems associated with windblown water and to also solve similar problems where any liquid leakage threatens to damage or destroy floors or floor covering.

DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

Figure 1:
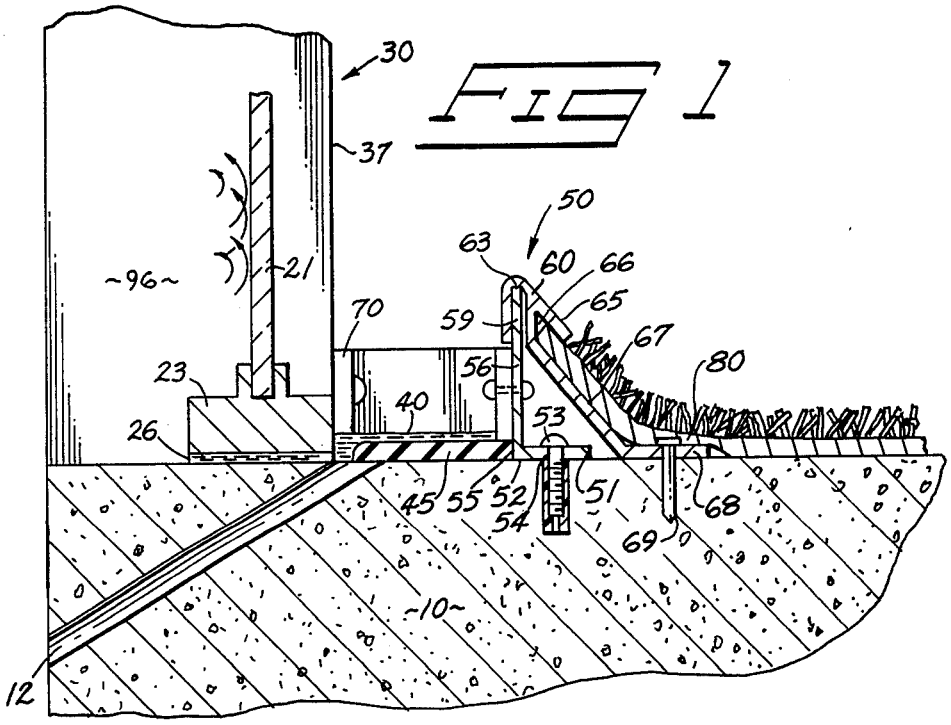
FIG. 1 is a cross-sectional view showing the flooring protection system installed adjacent to a window.

FIG. 1 shows a preferred embodiment of the flooring protection system of this invention. The flooring protection system 50 rests upon a floor 10 which may be constructed of concrete, wood or other suitable flooring material. A window frame 23 supports window pane 21 and rests upon floor 10. Window frame 23 is substantially even with the inside surface 31 of wall 30.

The flooring protection system 50 includes two principal parts. The first principal part is a barrier piece 52 which has an L-shaped cross-sectional configuration and acts as a dam to any liquid 40 collected nearby. The second principal part is a cover piece 60 which is supported upon barrier piece 52 at one end and at the opposite end upon floor 10. Cover piece 60 and barrier piece 52 form a strong structure which can be walked upon but is not conducive to tripping persons passing over it.

Figure 5:
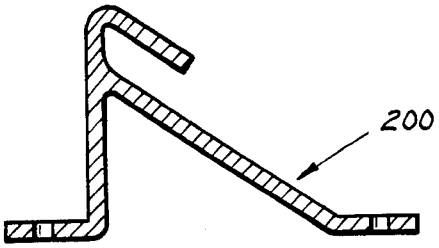
FIG. 5 is a cross-sectional view of an alternative embodiment wherein the barrier piece and cover piece are integral.

Barrier piece 52 is secured to floor 10 using anchors 53 which pass through openings 54 in the lower flange 51 of barrier piece 52. Flange 51 is preferably positioned under cover piece 60 to remove it from sight and provide a nicer appearance. Flange 51 can alternatively extend toward the window frame 23. In such a case it is possible to combine barrier piece 52 and cover piece 60 into one piece 200 as shown in FIG. 5. A sealant 55 is interposed between the barrier piece 52 and the floor 10 in order to seal out water or other liquid 40 which may accumulate in the space between window frame 23 and barrier piece 52.

Figure 2:
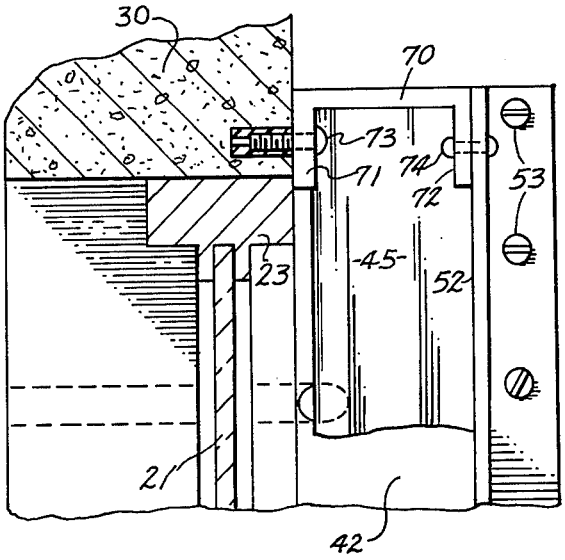
FIG. 2 is a plan view of the flooring protection system shown in FIG. 1 with the cover piece and floor covering removed for clarity of presentation.

FIG. 2 shows how liquid is retained in a contained area adjacent to window frame 23 using barrier piece 52 in conjunction with an end piece(s) 70. End piece 70 is preferably C-shaped when viewed above but other shapes are also acceptable. End piece 70 has a first flange 71 which is connected to wall 30 using a fastener 73 or suitable adhesive. The distal end of flange 71 is preferably overlapped against window frame 23. Second flange 72 is connected to the upstanding flange 56 of barrier piece 52 using a rivet 74 or some other suitable fastener. Sealant is placed around the inside perimeter of end pieces 70 and barrier piece 52 in order to seal liquid within the confined area 42.

Cover piece 60 is adapted to fit over the upper end 59 of upstanding flange 56. FIG. 1 shows a preferred embodiment of cover piece 60 having a receiving slot 63 into which the upper end 59 of barrier piece 52 fits. This connection or engagement between cover piece 60 and barrier piece 52 is usually a close fit but not an interference fit. It may be desirable in some cases to have an interference fit at this connection and this invention clearly contemplates such a structure.

Cover piece 60 also includes an overhanging lip 65 which defines a recess 66 into which the edge of a carpet 80 or other flooring material can be received. Overhanging lip 65 helps to protect the edge of flooring material 80 and holds it securely giving the flooring protection system a neat and finished appearance.

Cover piece 60 also includes an inclined ramp 67 which slopes downwardly toward the interior of the room providing an inclined supporting surface over which superjacent floor covering 80 is laid. The inward end or flange 68 of cover piece 80 is secured to floor 10 using fastener 69. Fastener 69 is preferably a nail positioned at intervals of about two feet but other types of figures and spacing intervals are possible. Inward end 68 can also be secured to floor 10 using adhesives or some other suitable means.

The appearance of the flooring protection system 50 is enhanced by using a piece of waterproof baseboard material 45 which is trimmed to fit in the confined area 42 to cover the otherwise exposed floor 10. A variety of materials may be used for base 45 although commonly available rubber or vinyl baseboard appropriately trimmed has been found suitable.

Floor 10 can be provided with a drain channel 12 through which water can pass to the exterior of the building. It is possible to omit drain channel 12 and to let the water flow out underneath the window frame through gap 26 which usually occurs in this type of construction because of the unevenness between window frames and the floor 10. It is also possible to mount the window frame 23 slightly raised above floor 10 in order to provide sufficient passageway 26 for water 40 to drain therethrough.

The flooring protection system shown in FIGS. 1 and 2 provides a simple and pleasant appearing way to contain windblown water and other liquids which may cause destruction of floor coverings or floors.

Figure 3:
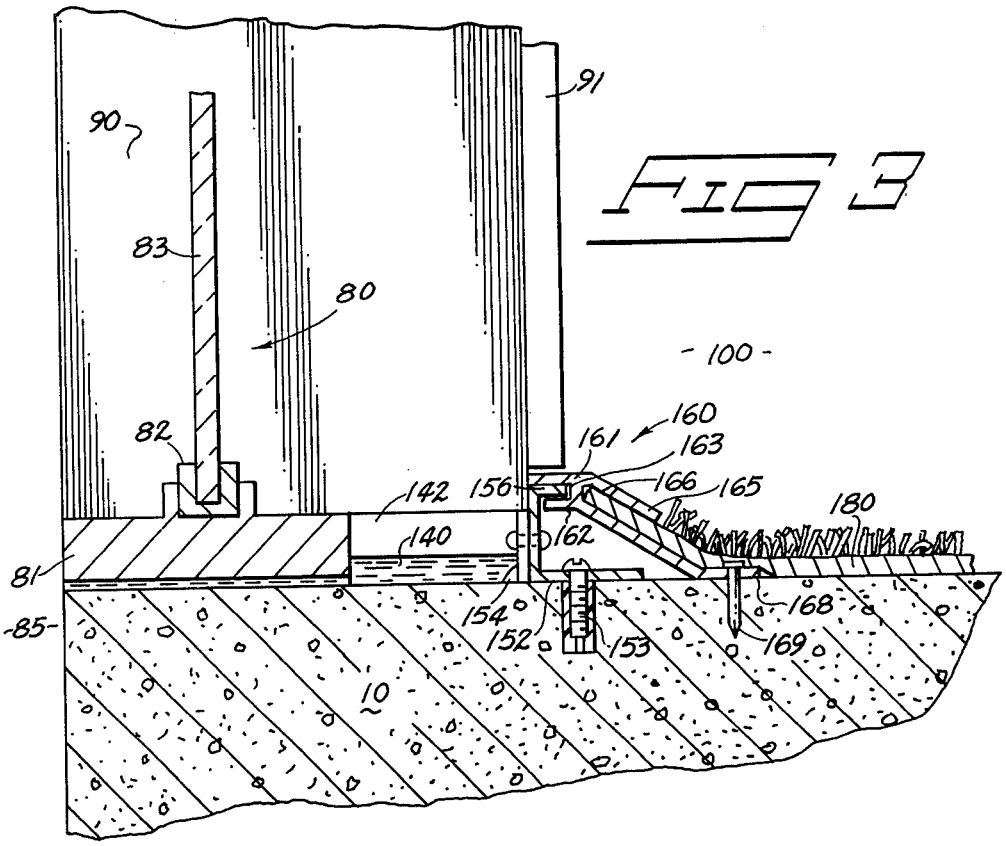
FIG. 3 is a cross-sectional view of an alternative embodiment of the flooring protection system.
Figure 4:
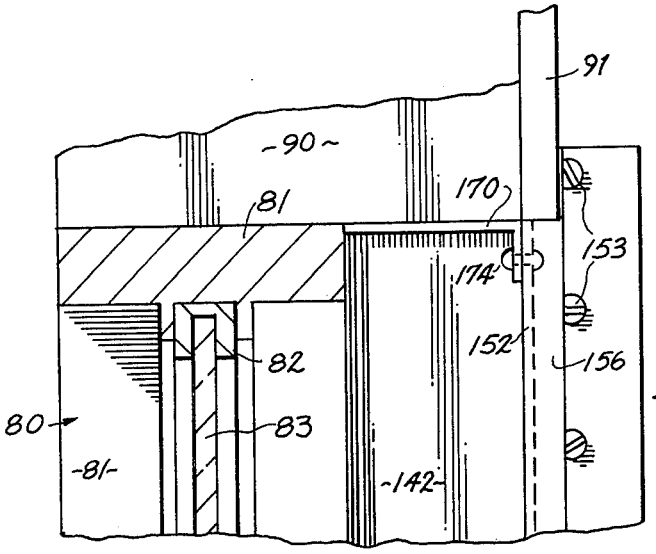
FIG. 4 is a plan view of the flooring protection system shown in FIG. 3 with the cover piece and floor covering removed for clarity of presentation.

Referring now to FIGS. 3 and 4 we see an alternative embodiment of the flooring protection system. Floor 10 has a sliding glass door 80 mounted thereon. Sliding glass door 80 has a door frame 81 which rests directly on floor 10. A sliding frame 82 is slidably mounted within frame 81 to support the pane of glass 83 and to allow ingress or egress through the sliding glass door 80. It is common for a channel or slot 85 to exist between frame 81 and floor 10 along at least a portion of the sliding glass door 80. Slot 85 may allow some water to enter the builiding but it also allows the water to escape when the wind has subsided.

Sliding glass door 80 abuts wall 90. Wall 90 extends inwardly further than frame 81 and is covered with a covering such as sheet rock 91. A barrier piece 152 is mounted against wall 90 after removing a portion of sheet rock layer 91. Barrier piece 152 is primarily L-shaped in cross-sectional configuration but has an upper flange 156 which extends substantially horizontally toward the interior of the room 100. Upper flange 156 is adapted to engage cover piece 160 which has two ribs 161 and 162 which form a recess 163 into which the end of upper flange 156 fits.

Cover piece 160 also has an overhanging flange or lip 165 which extends toward the interior of the room to define a recess 166 into which the edge of floor covering 180 fits. The interengagement between floor covering 180 and cover piece 160 helps to securely hold the edge of floor covering 180 and to protect it from wear and tear as people pass through the sliding glass door 80. The inward end 168 of cover piece 160 is preferably secured to floor 10 using a fastener 169. It is also possible to use adhesives or to not use any fastening means for the inward end 168.

Barrier piece 152 is provided with an end piece 170 which lies along the wall 90 and extends shortly across the face of barrier piece 152. End piece 170 and barrier piece 152 are secured together using a rivet or other fastening means 174. Anchors 153 are used to secure the barrier piece 152 to floor 10. Sealant such as a bead of caulking 154 is provided around the base of barrier piece 152 in order to prevent liquid leakage between the barrier piece 152 and floor 10. Sealant 154 also extends along all potential leak points associated with end piece 170, rivet 174 and their interaction with barrier piece 152.

Anchors 153 are preferably spaced about every six inches along the length of barrier piece 152 which is preferably a one piece unit of extruded metal or platic material. Anchors 153 are used as often as necessary to securely hold the barrier piece 152 to floor 10 to prevent any liquid leakage from the contained are 142. Any water or other liquid leakage in or around the sliding glass door 80 will collect in confined area 142 to form a reservoir 140. Reservoir 140 will drain out through space 85 during a storm or after the storm when the winds subside.

The configurations of barrier pieces 52 and 152 and cover pieces 60 and 160 hide the mounting screws 53 and 153 from view. This provides a very clean and neat appearing system for protecting floors and floor coverings yet retaining liquid leakage within a suitable enclosure. It is also possible to mount barrier pieces 52 and 152 with the lower flanges extending into spaces 42 and 142 rather than beneath cover pieces 60 and 160.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A flooring protection system for sealing along the surface of a floor near a window, door or other source of liquid, and for supporting floor covering in an attractive and protected position removed from the liquid, comprising:

a barrier piece positioned along the floor and including means to form a liquid-tight seal therewith; said barrier piece having an upstanding flange to act as a dam to any liquid collected nearby; and a cover piece supported by said barrier piece; and cover piece having an inclined ramp extending downwardly to the floor opposite from the source of liquid for stabilizing the upstanding flange of the barrier piece and supporting superjacent floor covering;

whereby liquid is contained on one side of the flooring protection system to protect the floor and floor covering from the destructive action of the liquid.

2. The flooring protection system of claim 1 wherein said barrier piece further comprises a lower flange connected to said upstanding flange; said lower flange being beneath said cover piece to remove the lower flange from view.

3. The flooring protection system of claim 1 wherein the barrier piece and cover piece are one piece with a lower flange on said barrier piece extending outwardly from said one piece.

4. The flooring protection system of claim 1 wherein said cover piece includes a slot for receiving the upstanding flange of the barrier piece to connect the barrier and cover pieces together.

5. The flooring protection system of claim 1 wherein said cover piece includes a slot adapted to receive the upstanding flange of the barrier piece in an interference fit.

6. The flooring protection system of claim 1 wherein said cover piece further comprises an overhanging lip running adjacent to the inclined ramp for protecting and holding the edge of floor covering extending up the inclined ramp.

7. The flooring protection system of claim 4 wherein said cover piece further comprises an overhanging lip running adjacent to the inclined ramp for protecting and holding the edge of floor covering extending up the inclined ramp.

8. The flooring protection system of claim 1 further comprising a drain channel running downwardly from a point near the barrier piece to a remote location for draining liquid from the contained area which is bounded by the flooring protection system.

9. The flooring protection system of claim 1 further comprising end pieces at each end to form a contained area with the window or door frame within which water is retained.

10. A flooring protection system for protecting a floor and floor covering from the destructive action of wind blown rain and water, including rain blown in around window and door frames, comprising:

a barrier piece having an upstanding flange to retain water within a contained area near the window, door, or other source of water;

a cover piece connected to the barrier piece and having an inclined ramp extending downwardly to the floor on the side of the upstanding flange opposite from the window, door or other source of water;

an overhanging lip attached to said inclined ramp near its upper end for protecting and securing floor covering supported upon the ramp.

11. The flooring protection system of claim 10 further comprising end pieces at each end to form a contained area with the window or door frame within which water is retained.

* * * * *